United States Patent [19]

Harris

[11] 4,179,109

[45] Dec. 18, 1979

[54] COLLATING EQUIPMENT INCLUDING COLLATOR AND CART

[75] Inventor: Jerome R. Harris, Charlottsville, Va.

[73] Assignee: Amprint Corp., Gordonsville, Va.

[21] Appl. No.: 868,038

[22] Filed: Jan. 9, 1978

Related U.S. Application Data

[63] Continuation of Ser. No. 789,341, Apr. 20, 1977, abandoned, which is a continuation of Ser. No. 623,749, Oct. 20, 1975, abandoned.

[51] Int. Cl.[2] ..... B65H 39/00

[52] U.S. Cl. ..... 270/52

[58] Field of Search ..... 270/5-20, 270/40-41, 43-52.5; 226/2-3, 6, 57; 101/224-225, 227-228

[56] References Cited

U.S. PATENT DOCUMENTS

| | | | |
|---|---|---|---|
| 1,111,321 | 9/1914 | Raabe | 270/5 |
| 1,873,232 | 8/1932 | Wood | 270/5 |
| 2,904,332 | 9/1959 | Metzner | 270/52.5 |
| 3,147,969 | 9/1964 | Martin | 270/52 |
| 3,237,934 | 3/1966 | Rosenberg | 270/53 |
| 3,512,770 | 5/1970 | Schuffenhauer | 270/52 |

*Primary Examiner*—Edgar S. Burr
*Assistant Examiner*—A. Heinz
*Attorney, Agent, or Firm*—Amster, Rothstein & Engelberg

[57] ABSTRACT

The present invention relates to novel collating equipment used in the printing of booklets, magazines, pamphlets or similar multi-page matter. The collating equipment includes a collator and a cooperating combined storage and feeding cart. The collating operation is performed in a collator containing a series of substantially identical work stations. A roll of preprinted material having two web sections or ribbons wound on a common core is placed in the cart and engaged in each collating station. The collator places each ribbon in superposed relationship to the corresponding ribbon at each location. The pairs of ribbons are then directed to the next location in the collator where the first pair of ribbons is placed in superposed relation to a next pair of ribbons. This operation is repeated until the entire printed matter is collated into a continuous stack of collated ribbons.

17 Claims, 10 Drawing Figures

FIG. 5.
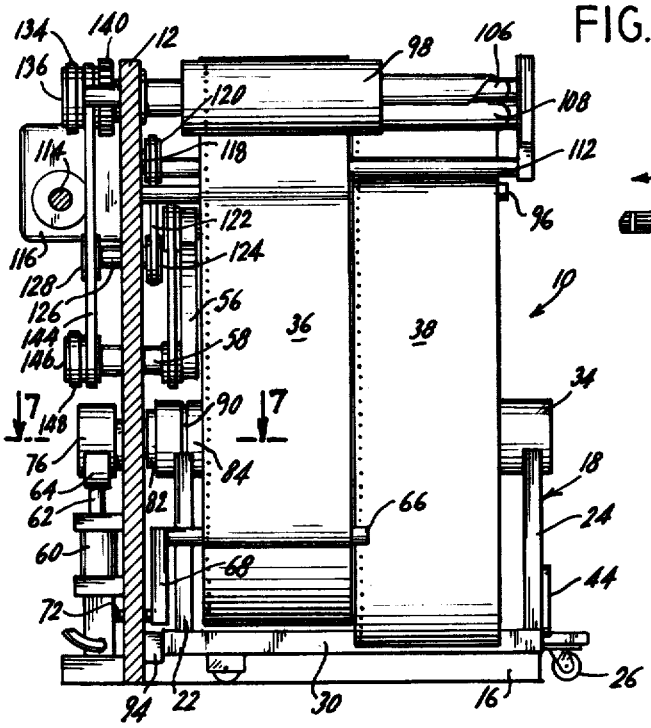
FIG. 9.
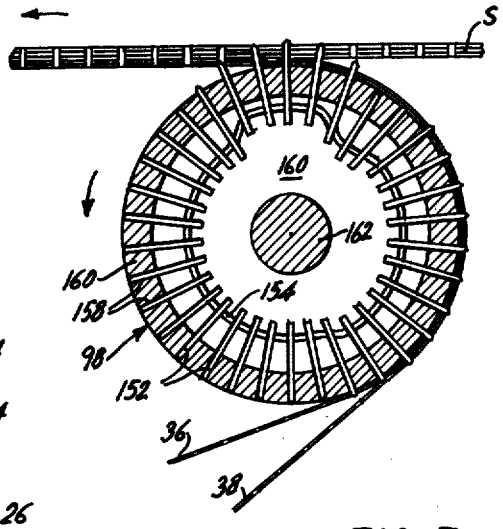
FIG. 7.
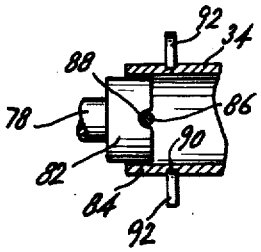
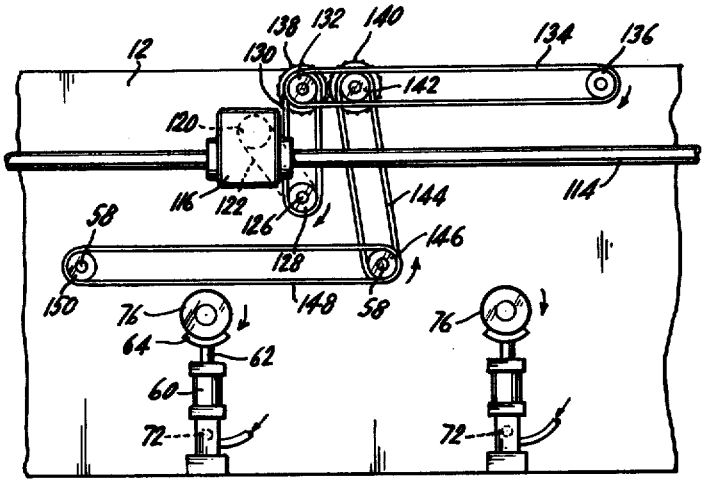
FIG. 10.
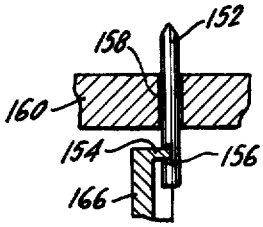
FIG. 6.
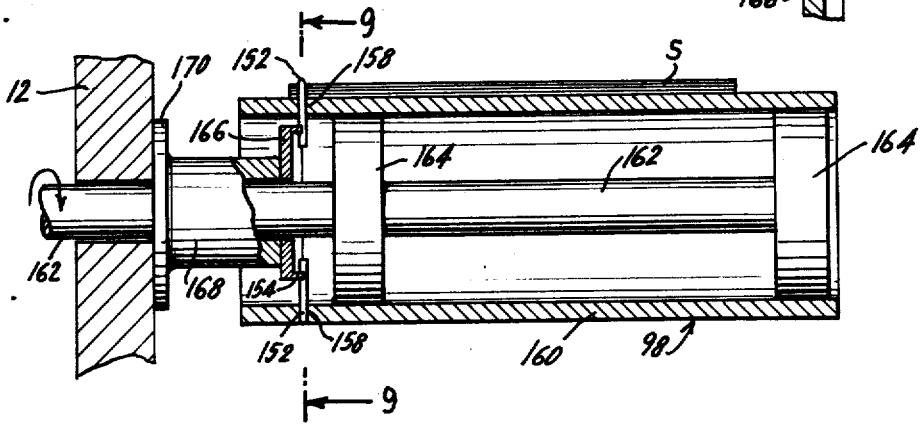
FIG. 8.

COLLATING EQUIPMENT INCLUDING COLLATOR AND CART

This is a continuation, of application Ser. No. 789,341 filed Apr. 20, 1977, now abandoned, which was a continuation of application Ser. No. 623,749, filed Oct. 20, 1975, now abandoned, which was a continuation of application Ser. No. 623,749 filed Oct. 20, 1975, now abandoned.

The present invention relates generally to collating equipment useful in the printing of booklets, magazines, pamphlets and similar printed material and particularly to collating equipment used for the precise on-line collation of materials printed on a web fed press which is compatible with on-line binding and finishing operations.

Conventional web printing apparatus typically includes collating equipment associated with the press. Generally, a wide multi-section web is printed on the press; and as the printed web emerges, it is slit into corresponding multiple web sections or ribbons. Each ribbon is individually directed over turning rollers which orient the multiple ribbons into a collated stack of material. The precise registration of the printed material on the respective ribbons is a function of the length of the path traveled by each ribbon. Next, the collated stack of ribbons is cut into lengths corresponding to two pages of the final product forming short stacks of collated material. The short stacks are then folded forming what is known in the art as "signatures". Each signature is then unloaded manually and carried to a separate piece of equipment where the necessary number of signatures are joined to form a magazine, pamphlet or similar multi-page material.

Such conventional collating apparatus has many disadvantages. Most significant is the interdependence of the printing press and the collating apparatus. If there is a problem with the printing press, the combined printing and folding line must be shut down. Further, since it is necessary to use a wide web to print a sufficient quantity of pages to form a large enough signature after collation, the wide web is more difficult to maintain in constant tension and is thus more likely to break each time the press is started, stopped or the printing speed is changed. If the web does break, much manual work is required to correlate the partially collated printed material before the press can be restarted.

Since the length of the path over which each individual ribbon travels after being slit from the wide web determines the final orientation between the respective pages printed on the multiple ribbons, it is apparent that extensive set up is required to assure reasonably accurate collation. The time used to set-up the collation apparatus is time during which the press must stand idle. Similarly, substantial time must be spent setting up the press to print the wide web. Likewise, during this period of time, the collator cannot be used.

After the ribbons are collated and cut into signatures, such signatures must be manually brought to the next station and loaded into the binding and trimming equipment. Necessarily, this manual operation requires additional personnel and typically results in damage to substantial quantities of the partially finished printed material. This likelihood of damage necessitates the printing of sufficient overruns of material to assure that there will be an adequate amount of undamaged signatures for binding and trimming after normal plant shrinkage.

Further, conventional collating equipments are not readily adaptable to varying numbers of pages as the number of pages collated at any given time is solely dependent upon the width of the web printed in the press.

It is broadly an object of this invention to provide collating equipment which overcomes or avoids one or more of the foregoing disadvantages resulting from use of conventional equipment. Specifically, it is within the contemplation of the present invention to provide a multi-station collator and an associated storage and feed cart that are particularly adapted to the flexible and efficient collation of multi-page printed material in an equipment that is essentially independent from the associated printing press. Accordingly, this invention provides collating equipment that is independent of the printing press whereby set-up, delays or breakdowns in printing will be independent from the collation operation and vice versa.

A further object of the present invention is to provide collating equipment that is specifically adaptable to collation of printing matter on narrow webs without sacrificing the ability to collate finished products with large numbers of pages.

A still further object of this invention is to provide collation equipment which is particularly adapted to achieve binding and finishing the final product in a continuous and on-line operation.

A still further object of this invention is to provide collating equipment that avoids the necessity of manual handling of unfinished signatures thereby reducing the amount of damaged material and increasing plant output.

A still further object of this invention is to provide collating equipment that only requires handling of the printed material in roll form thereby minimizing the likelihood of damage.

A still further object of this invention is to provide equipment which is capable of high speed collation of multiple page printed material and can set up in a relatively short period of time, thereby avoiding the necessity for painstaking adjustments to assure reasonably precise collation.

A still further object of this invention is to provide collating apparatus which is easily adaptable for collating multi-page documents each having different numbers of pages whereby it is economically feasible to utilize such apparatus for collating relative short runs of different documents (i.e. magazines varying from 8 pages to well over 100 pages.

A still further object of this invention is to provide related handling equipment that minimizes handling by being specifically adapted to store the printed material in roll form, to be movable to a storage area and to be engageable in the multi-station collating equipment wherein the rolled, printed material can be fed into the collating equipment without requiring removal from the handling equipment.

In accordance with one embodiment of the present invention, there is provided an apparatus for collating printed material on a web roll wherein each web has wound thereon separate first and second preprinted web sections. Each web section contains a series of aligning holes along one edge of the web section, which aligning holes are utilized during the collation process. The collator apparatus is comprised of a frame upon which multiple work stations are located. Each work station is specifically adapted to receive one web roll containing two web sections wound on a common core. After the web roll is engaged in the work station, a roll drive means is engageable along the surface of one wound web section causing the web roll to unwind at the proper speed for collation.

Each work station contains a series of rollers or angle bars over which each web section is directed. Specifically, the innermost web section, that section closest to the frame of the collator, is unwound and directed over a corresponding powered roller mounted on the upright frame of the collator at each work station by a first set of positioning rollers. The outermost web section is unwound and directed over a second series of positioning rollers which carry the outermost web section into coextensive relation with the innermost web section with the outermost web section being placed on top of the innermost web section as the pair of web sections pass over the powered roller.

The powered roller contains a plurality of radially extensive aligning pins which engage corresponding aligning holes in each web section. The powered roller or pinroller maintains the two ribbons in superposed relationship while directing the pair of ribbons to the next work station or out of the collator.

Further, there is provided a combined storage and feed cart specifically adapted to supporting the web roll in each work station of the collator apparatus. The cart contains a horizontal support with front and rear upstanding walls mounted thereon. Each upstanding wall contains core receiving means specifically adapted to receive the extending front and rear portions of the core about which the web sections are wound. The core receiving means contain bearings upon which the core rests enabling the web sections to be unwound from the core while the core is supported within the cart.

The cart is specifically dimensioned to be positioned at each work station of the collator. The upstanding walls of the cart are of corresponding height to the collator whereby the web roll in the cart is engaged in the collator with the cart supporting the weight of the web roll and core assembly. The cart also contains a plurality of wheels to enable the cart containing the web roll to be moved to a storage area as an assembly and taken from storage at a later time for engagement in the collator without requiring the handling of web roll.

The above brief description as well as further objects and features and advantages of the present invention will be more fully understood by reference to the following detailed description of a presently preferred nonetheless illustrative collating equipment in accordance with the present invention when taken in conjunction with the accompanying drawings, wherein:

FIG. 5 is a side elevation view taken along lines 5—5 in FIG. 3 showing one collating station;

FIG. 6 is a side elevation view of the farside of the upright wall of the collator showing the notched drive belts, drive shaft and the brake assembly;

FIG. 7 is a partial section taken along line 7—7 of FIG. 5 showing the interconnection between the hollow core and the collator;

FIG. 8 is a partial section taken along line 8—8 in FIG. 4 showing the fixed and rotary components of the pinroller assembly;

FIG. 9 is a partial section taken along line 9—9 in FIG. 8 showing the interaction of the pins and the camming edge in the pinroller assembly.

FIG. 10 is a detailed view of the engagement of the pin with the camming edge inside the pinroller assembly.

Figures 1, 2:
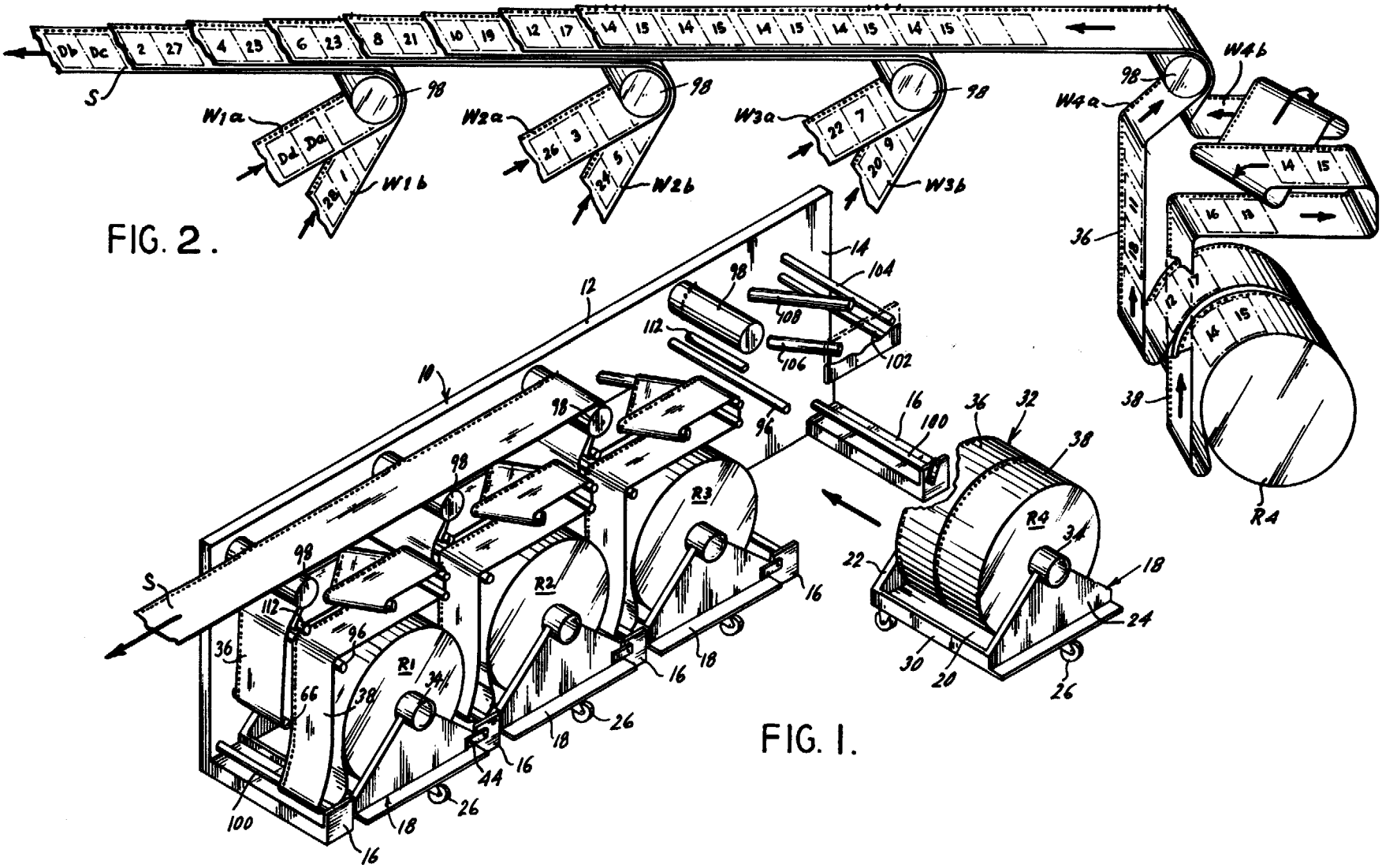
FIG. 1 is a perspective view of the collator apparatus showing three stations in operation and printed ribbons on a fourth cart being inserted into the fourth work station.
FIG. 2 is a diagrammatic view of the collation process occurring at each station.

Referring specifically to the drawings, there is shown in FIG. 1, a collator generally designated by reference numeral 10. Said collator is comprised of an upstanding frame 12 having a front surface 14 from which project locating structures 16 delineating a plurality of work stations of the collator 10. Each work station contains an opening defined by adjacent locating structures 16 with said opening being adapted to receive a combined storage and holding cart generally designated by reference numeral 18.

Each cart 18 contains a horizontal bottom portion 20, an upstanding front support 22 and an upstanding rear support 24. Said cart 18 contains casters or wheels 26 so it can be rolled from the storage area into engagement with the collator 10. The longitudinal orientation of the cart 18 within the collator 10 is achieved by position rollers 28, best shown in FIG. 4. Said rollers 28 engage the side rails 30 along the sides of the horizontal bottom portion 20 of the cart 18.

Generally, each cart 18 supports a printed web, designated by reference numeral 32. Printed web 32 is a narrow web printed in a conventional business forms press wherein each side has been printed in the required number of colors. After such printing operation, the web passes into a processing unit wherein the web is punched with a plurality of holes approximately one-eighth inch in diameter along its entire length at one edge of the web and a second plurality of holes along the opposite side of the center line of the web. Next, the web is slit along the center line forming two corresponding, symmetrical web sections or ribbons, each ribbon having a plurality of one-eighth inch diameter punched holes along its innermost edge. Each ribbon contains the printed material for two pages on each side, oriented in such manner that each web contains eight printed pages in the proper sequence to be collated with other webs into a booklet containing the total number of pages. As shown in the rightmost portion of FIG. 2, web R4 is slit into inner ribbon W4*a* and outer ribbon W4*b*. The pages printed on web R4 are so oriented that other ribbon W4*b*, when translated into coextensive relation with ribbon W4*a* results in pages 11 through 18 being properly oriented with relation to each other in a continuous ribbon containing repeating stacks of eight pages. The continuous ribbon of collated pages printed on web R4 then passes to the second station where outer ribbon W3*a* and inner ribbon W3*b* of web R3 are added to the superposed stack of ribbons forming a properly oriented stack of ribbons that now contains repeating groupings of collated pages 7 through 22. Similarly, the collated, superposed stack of ribbons advances to the next work station where web R2 containing inner ribbon W2*a* and outer ribbon W2*b* are added to the stack. The stack now contains repeating groupings of collated, superposed pages 3 through 26. Finally, the stack moves to the last work station where web R1 containing inner ribbon W1*a* and outer ribbon W1*b* are added completing the 28-page booklet and 4-page cover in the stack of ribbons designated in FIG. 2 by the letter S.

As shown in FIG. 2, each printed web 32 contains two symmetrical ribbons, the inner ribbon generally designated 36 and the outer ribbon designated 38. After being printed, punched and slit as described above, the inner and outer ribbons 36, 38 are wound on a common hollow core 34. The assembly of core and ribbons is then placed in cart 18 for engagement in the collator 10 or for storage in another location until the printing operation is completed and all the webs are ready for insertion.

Figure 3:
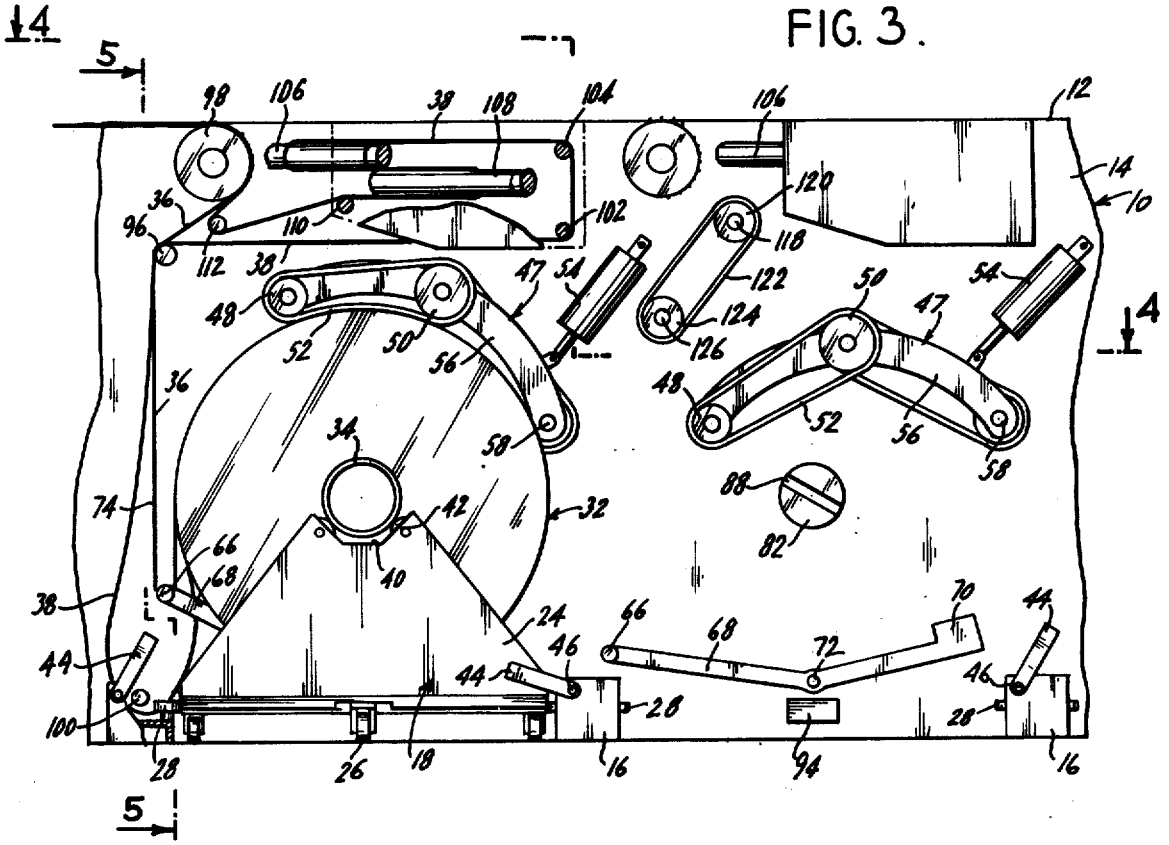
FIG. 3 is a side elevation view of the near side of an intermediate section of the collator showing two collator stations; one containing a cart and ribbon assembly and the other awaiting the engagement of such assembly.

FIG. 3 shows two work stations in the collator 10. The leftmost work station is shown with cart 18 inserted therein. Cart 18 contains the printed web 32 wound on the hollow core 34. The upstanding rear support 24 of cart 18 contains a core-receiving seat 40 along the topmost edge. Two core rollers 42 provide support for the core 34 and are adapted to allow the core to rotate with minimal friction while positioned within the cart 18. Cart 18 is held in place in each work station of the collator 10 by locking lever 44 which rotates about a pivot pin 46 in locating structure 16. When locking lever 44 is in the position shown in the leftmost station in FIG. 3 it engages the rearmost surface of upstanding rear support 24 preventing cart 18 from disengaging from the work station.

During the collating operation, web 32 must be rotated in the counterclockwise direction when viewed in FIG. 3. Since it is necessary to control the linear speed of the ribbon being unwound from web 32, said web is rotated by a surface-driving means. The surface-driving means, generally designated 47, is comprised of drive rollers 48, 50 and drive belt 52. Drive belt 52 is held in contact with the outermost surface of web 32 by hydraulic cylinder 54. Hydraulic cylinder 54 connects the drive frame 56 to which drive rollers 48, 50 and the assembly is pivotably mounted to the frame 12 of the collator 10 whereby expansion of the hydraulic cylinder 54 causes drive frame 56 to rotate in the counterclockwise direction about drive shaft 58 and to cause drive rollers 48, 50 and drive belt 52 to firmly engage the surface of printed web 32. This drive arrangement is critical to the effective operation of the collator 10 since constant clockwise rotation of drive belt 52 is translated to constant linear motion of both the inner and outer ribbons 36, 38 on each printed web 32 without regard to the diameter of the printed material remaining on the roll. If the web roll 32 had been driven through the core 34, a more complex, variable speed means would be required to increase the speed of rotation as the diameter of material on the printed web 32 decreased, to maintain a constant linear speed of unwind of the ribbons 36, 38.

The speed of unwinding of the web 32 is also controlled by an hydraulic brake 60. The hydraulic brake 60 has an extending arm 62 and a brake shoe 64 mounted to the extending arm 62, as best shown in FIG. 6.

Brake shoe 64 is shaped to cooperate with brake drum 76 mounted on brake shaft 78, which extends through the far side of frame 12 of collator 10. Brake shaft 78 has mounted thereon, core connector 82 on the front side of the frame 12. Said core connector 82 is of diameter small enough to be insertable into the internal portion of hollow core 34. The forward end 84 of each hollow core 34 has an engaging pin 86 located therein transverse to the axis of said hollow core. Said engaging pin corresponds to and is engageable with cross notch 88 in the core connector 82 whereby when the cart 18 containing the printed web 32 is fully engaged in a work station on the collator 10, the core connector 82 enters the hollow core 34 causing the cross notch 88 to engage engaging pin 86, thereby keying the rotation of printed web 32 to the brake shaft 58.

The details of the engagement between the core connector 82 and the engaging pin 86 are best shown in FIG. 7. When the cart 18 is fully engaged within the respective work station on the collator 10, the core connector 82 enters the internal portion of the core 34 causing the cross notch 88 to engage the engaging pin 86.

The hydraulic brake 60 is controlled by dancer roller 66 mounted on lever arm 68. The end of lever arm 68 opposite dancer roller 66 contains a counterweight 70 to decrease the force necessary to cause lever arm 68 to rotate pivot pin 72 causing modulation of the action of hydraulic brake 60. In operation, the inner ribbon 36 is wound around dancer roller 66 before being directed to the upper end of the collator, forming loop 74 in the path of inner ribbon 36. When the tension on inner ribbon 36 increases, loop 74 becomes shorter, causing dancer roller 66 to move clockwise upwards rotating lever arm 68 about pivot pin 72. Clockwise rotation of lever arm 68 decreases the braking pressure of hydraulic brake 60 allowing web 32 to rotate more freely. Freer rotation of web 32 results in a slight increase in the amount of inner ribbon 36 unwound from web 32. Consequently, loop 74 increases allowing dancer roller 66 to rotate a small amount in the counterclockwise direction. Intermittent increasing and decreasing of the braking force results in the proper length of loop 74 to assure smooth unwinding of the web 32.

To assure that printed web 32 remains in contact with brake shaft 78 and in proper lateral orientation with regard to back wall 12 of the collator 10, the hollow core 34 contains a circumferential groove 90 on the outer surface of the forward end 84 of the core 34. Core-locating rollers 92 on the upstanding front support 22 of cart 18 engage said circumferential groove 90 to prevent laterial motion of said printed web 32. Thus printed web 32 is held in precise location in cart 18 by the core locating rollers 92 and cart 18 is located relative to the frame 12 of collator 10 by stop block 94 which engages the frontmost surface of the horizontal bottom portion 20 of cart 18 (see FIG. 5). The longitudinal position of cart 18 in collator 10 is maintained by position rollers 28 on locating structures 16 as discussed above, which rollers also assure that the cart 18 and web 32 remain perpendicular to the frame 12 of collator 10.

Figure 4:
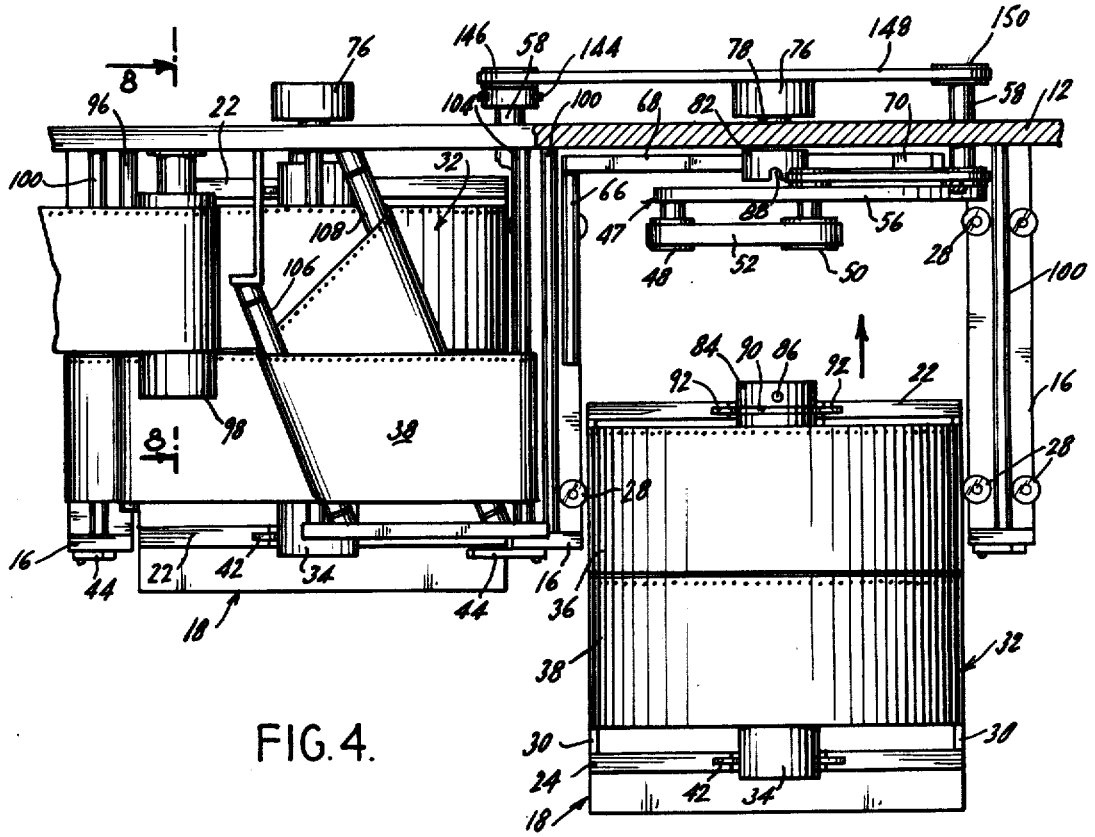
FIG. 4 is a partially sectioned, top view taken along 4—4 in FIG. 3 showing the two collating stations, one having a cart and ribbon assembly engaged therein and the other having such assembly partially inserted.

The rightmost portion of FIG. 4 shows a second printed web 32 mounted in a cart 18 being engaged within a work station on the collator 10. The position rollers 28 on the locating structure 16 cooperate with the sides of the horizontal bottom portion 20 of the cart 18 as said cart is moved in the direction shown by the arrow to engage the hollow core 34 with the core connector 82.

The leftmost work station shown in FIG. 4 has mounted therein a printed web 32 having inner ribbon 36 and outer ribbon 38 engaged within the plurality of rollers in the upper portion of the collating station. When so engaged in the collator, the inner ribbon 36 is fed from the printed web 32 downward, around dancer roller 66 forming loop 74 and then upwardly over wide roller 96. From said wide roller 96, inner ribbon 36 is threaded over pinroller 98. The operation of the pinroller will be described below. After passing over the pinroller 98, the inner ribbon 36 is directed towards the next down-line work station.

The outer ribbon 38 follows a more complex path as it must be translated inwardly towards the frame 12 of the collator 10 to become coextensive with the inner ribbon 32. The outer ribbon 38 is fed downward from the printed web 32 over idler roller 100. After passing over the idler roller 100, the outer ribbon 38 is directed upwardly over wide roller 96 towards the right, FIG. 4 around lower roller 102 and upwards around upper roller 104. Next, the outer ribbon 38, which is still coextensive with the remainder of the outer ribbon 38 on the hollow core 34, is directed towards the first angle roller 106 where the outer ribbon 38 is redirected towards the frame 12 of the collator 10. Next, the outer ribbon 38 is directed over the second angle roller 108, after which the outer ribbon 38 is in coextensive relationship with the inner ribbon 36. After passing over the second angle roller 108, the outer ribbon passes over a second idler roller 110, around a third idler roller 112 and finally, into superposed relationship with the inner ribbon 36 at the pin roller 98 such that the outer ribbon 38 is on top of the inner ribbon 36. Each station of the collator contains the corresponding rollers described above to translate the path of each outer ribbon into coextensive relationship with its corresponding inner ribbon and the two collated ribbons are directed to the next collation station where they are joined with a second set of two collated, superposed ribbons. The precise collation of the printed pages on each ribbon in the stack of ribbons is accomplished by the pinrollers in the manner described below.

As is apparent from the description of the relative paths of travel of the inner and outer ribbons, the outer ribbon travels a greater distance. Consequently, it is not possible to align the printed image on the inner ribbon 36 with the image on the outer ribbon 38 printed simultaneously on the printed web 32 before it is slit into the two ribbons 36, 38 in the processing unit, as described above. Consequently, the first, second and third idler rollers, 100, 110 and 112, respectively, are so spaced to result in the first printed image on the inner ribbon 36 being collated in superposed relationship with the third printed image on the outer ribbon 38. Similarly, the second printed image on the inner ribbon is collated with the fourth image on the outer ribbon and so forth, through the entire printed web 32. The collation of a printed image on the inner ribbon 36 with a printed image to images further down the outer ribbon 38 was selected to assure that the collation of the printed material on the inner and outer ribbons 36, 38 is maintained with great precision. In the offset printing process, the press plate is mounted on the plate cylinder. The image from the press plate is then transferred to the blanket cylinder, however the diameter of the blanket cylinder is precisely twice the diameter of the plate cylinder so that two identical images of the press plate are transferred to the blanket cylinder. Consequently, to accommodate tolerance build-up and other uncontrollable factors, most precise collation can be accomplished by only placing first images in superposed relationship with the first images and second images in superposed relationship with second images. The precise collation is accomplished by the engagement of the aligning pins in the aligning holes of the ribbons 36, 38.

FIGS. 5 and 6 show the drive mechanism on the far side of the frame 12 of collator 10. Since the rotation of inner and outer ribbons 36, 38 at each work station must be precisely correlated to the corresponding ribbons at the next work station, it is extremely critical to the operation of the collator 10 that the power input to each collator station be of constant speed with regard to the other stations. To this effect, a drive shaft 114 is utilized driving a right angle gear box 116 at each work station. The output shaft 118 of said gear box 116 passes through the frame 12 and has an output pulley 120 mounted thereon. Said output pulley 120 turns a first notch belt 122. Said belt powers an auxiliary pulley 124 connected to jack shaft 126, which shaft 126 brings the input power back to the far side of frame 12 to driving pulley 128. A second notch belt 130 on driving pulley 128 carries the output power to double pulley 132. Said double pulley 132 is keyed to the pinroller 98 on the opposite side of the back wall 12 so that rotation of the pinroller 98 will be coupled to the rotation of the drive shaft 114.

Although it would be possible to repeat the gear box and related drive components at each work station, it has been found that one gear box for each two work stations is sufficient. Thus, double pulley 132 has thereon third notched belt 134 which carries the input power to a driven pulley 136 keyed to the pinroller 98 on the second work station.

The web surface-driving means, described above, is also driven off the drive shaft 114. Adjacent double pulley 132, and keyed to said pulley is a drive gear 138. Said drive gear engages driven gear 140 on a shaft, journaled to what has been designated the far side of the frame 12 of collator 10. As is shown in FIG. 6, the drive gear 138 rotates in the clockwise direction, and driven gear 140 in the counterclockwise direction. A driving pulley 142 is attached to said driven gear 140. Said driven gear 140 then rotates in the counterclockwise direction causing a fourth notched belt 144 to likewise rotate.

Said fourth notched belt 144 engages the inner segment of a second double pulley 146 on drive shaft 58. Said drive shaft 58 brings the power input into the surface driving means described above.

Since each gear box 116 is used to power two adjacent work stations, it is most convenient for double pulley 146 to be attached to drive shaft 58 on the second work station with a fifth notched belt 148 on the second segment of the second double pulley 146. Said fifth notched belt 148 carries input power from the drive shaft of the surface driving means 47 of the second work station to a driven pulley 150 on the drive shaft 58 of the first work station.

Operating two adjacent work stations from the same gear box 116 improves the constant speed operation of the collator 10. The identity of speed of rotation of pinroller 98 at each adjacent work station is assured since constant speed of rotation of the input and output shafts is assured whenever the driving and driven pulleys or gears of each pair are of the same diameter. Uniformity of speed of rotation throughout the entire collator assembly is assured by use of identical gear boxes 116, each of which is powered from the same main drive shaft 114 so the input speed at each gear box 116 will be the same.

The pinroller 98 of the type utilized in this collator is generally known, but has been specifically adapted to utilization in this collator assembly. The pinroller 98 serves two related functions in the collator 10. First, when the inner and outer ribbons 36, 38 are initially placed in superposed relationship at each work station, the two ribbon thick stack passes over the pinroller 98, first contacting the pinroller 98 at approximately the five o'clock position shown in FIG. 9. The plurality of pins 152 engage the punched holes along the inner edge of the stack of ribbons S. Said pins 152 assure that the ribbons will be precisely aligned and collated, since the material printed on the ribbons is in register with the line of punched holes. As discussed above, the relative length of the paths of the inner ribbon and outer ribbon 36, 38 will generally allow the printed images on one ribbon to be precisely aligned with the corresponding image on a second ribbon, while the pins 152 assure that the alignment is to a very close tolerance.

After the inner ribbon and outer ribbons 36, 38 are precisely placed in superposed, collated relationship on the pinroller 98, said pinroller 98 performs its second function, collation of that pair of ribbons 36, 38 with the collated stack of ribbons that have been directed to the pinroller 98 from the adjacent, up-line work station. To perform this collating operation, the pins 152 must be caused to project from the pinroller 98 in approximately the one o'clock position shown in FIG. 9 to engage the stack of multiple ribbons of collated material.

Since the two functions of the pinroller require specific radial motion of the pins 152 a complex profile camming edge 154 is used to control the motion of the pins 152. Specifically, pinroller 98 includes a series of extensible and retractable pins 152 along the surface of pinroller 98 adjacent the back wall 12 of collator 10. The pinroller turns counterclockwise as shown by the arrow in FIG. 9 with said pins 152 retracted between the approximately eleven o'clock and six o'clock positions. At approximately the five o'clock position, the pins begin to extend, first engaging the inner ribbon 36 and, as the pinroller continues to rotate counterclockwise with the pins projecting approximately the same distance, said pins 152 engage the outer ribbon 38. Finally, as the approximately two o'clock position approached, said pins 152 retract until the one o'clock position, at which point the previously collated pairs of ribbons from the up-line work station have their punched holes in alignment with each other. Thereupon, the pins 152 are driven rapidly upward to retain the collated orientation of the stack of ribbons and to transport the stack of ribbons onto the next pinroller at the adjacent, down-line work station. The pins 152 retract at approximately the eleven o'clock position to allow the stack of ribbons to move in a substantially horizontal direction to the next station.

The complex motion of the pins 152 is accomplished by the engagement of the camming edge 154 with a corresponding groove 156 in each pin 152 as shown in FIG. 10. The interaction between the camming edge 154 and the groove 156 provides a reciprocating action without the need of springs or similar retracting devices. The pin 152 moves radially relative to the axis of pinroller 98. The pin 12 is maintained in such orientation by corresponding radial apertures 158 in the cylindrical wall 160 of pinroller 98. Said apertures 158 are of diameter complimentary to the diameter of pins 152 whereby said pins move in the radial direction only.

The operation of pinroller 98 includes rotating and stationary components as shown in FIG. 8. Specifically, input shaft 162 is rotated by double pulley 132 (or driven pulley 136) which is powered by secod notch belt 130 (or third notch belt 134). The rotational motion of input shaft 162 is translated to the cylindrical wall 160 of pinroller 98 through drive plates 164 journaled to said input shaft 162 and connected to the inner surface of cylindrical wall 160. Pins 152 mounted within apertures 158 in cylindrical wall 160 of pinroller 98 are caused to rotate with said pinroller 98. The camming edge 154 on cam plate 166 is journaled to collar 168. Said collar 168 has a shoulder 170 which is rigidly fastened to the near side of frame 12 of collator 10 preventing the rotation of cam plate 166 and providing a bushing within which input shaft 162 can rotate.

When input shaft 162 is rotated driving pinroller 98, pins 152 are also caused to rotate. The cooperating groove 156 in each pin 52 is drawn over the fixed camming edge 154 causing said pins to follow the profile of the camming edge 154 during rotation.

Each pinroller 98 located at each work station propels the stack of ribbons to the adjacent down-line work station. The precisely timed extension and retraction of pins 152 moves such stack of ribbons, which may total over twenty four printed ribbons (when twelve collating stations are used), without ripping the punched holes, or adjacent portions of the ribbons while maintaining the precise superposed relationship between the ribbons in the stack and keeping said ribbons precisely collated. The precise coordination between the speed of rotation of each pinroller 98 in each work station with its adjacent pinrollers allows the aligned, collated ribbon to be continuously propelled down-line work stations while maintaining the superposed relationship. After the last work station the stack of ribbons S can be directed on-line to the binding and trimming equipment completing the magazine, booklet or similar material.

Thus, an embodiment of the present invention provides a combination of a collator equipment and a plurality of roll supporting carts, each cart being constructed and arranged to rotatably support therein a web roll having first and second side-by-side web sections wound on a common core. The collator includes an elongated support or frame along which a plurality of cart receiving stations are located at spaced locations. Each work station is constructed for side loading of the roll supporting cart from the side opposite the inner wall of the frame. The web roll mounted in each cart is then oriented so that the first and second web sections on the web roll are placed into unwinding position in each workstation in relation to the longitudinal plane of the frame of the collator.

Each work station includes web roll drive means mounted on the inner support wall which drive means extend into the area occupied by the innermost web section of the web roll to engage the surface of that web section to rotate both web sections on the common core during collation. The collator also contains a plurality of web directing rollers around which the outermost web section is wound, which directing rollers translate the outermost web from its position in the outer medial half-section of the work station into collated and superposed position with the innermost web section. The superposed pair of web sections is advanced to an adjacent work station by advancing means mounted on the inner support wall of the collator. This web advancing means is located in the inner medial half-section of the work station and is adapted to engage the superposed first and second web sections of the web roll mounted in the work station and to advance these web sections into collated relation to corresponding pairs of web sections at one or more of the longitudinally spaced work stations of the collator.

The collator of this invention accomplishes high speed collation of multiple stage printed material without being dependent upon or operationally related to the printing equipment. The collator is specifically adapted to collate multiple rolls of preprinted, preprocessed material on narrower web rolls without sacrificing production output. Ideally, the entire magazine, booklet or similar printed material is printed on a plurality of web rolls, each web roll being stored until the entire printing operation is completed. The plurality of web rolls are then inserted into the respective work stations in the collator, and the collating operation started. Consequently, delays, set-up or breakdowns during the printing operation do not effect subsequent collation. Similarly, the minimal time needed to set up the collating equipment does not interfere with the operation of the printing press.

The collator of this invention is specifically well suited to cooperating with binding and trimming equipment to allow on-line finishing of the collated material. The continuous stack of superposed, collated material is directed by the same pinrollers, on line, to associated equipment for binding and finishing. Once the collating process is started in this equipment, the printed material need not be manually handled until the finished product emerges from the associated binding and finishing equipment.

The collating equipment disclosed herein totally eliminates the manual handling of signatures. The original preprinted and preprocessed material is rewound into roll form with two web sections on a common core and the entire assembly placed in a combination storage and feeding cart for the collation operation. The maual handling of the printed material in general is minimized and handling of the easily damaged signatures is specifically eliminated. The handling of printed material in roll form reduces the likelihood of damage and reduces the necessity for printing overruns otherwise necessary to assure that there will be sufficient quantities of undamaged material for binding and finishing. Cost savings from the use of this equipment is increased by minimizing the number of persons needed to handle the printed material during the process.

The collating equipment of this invention is easily set up for the respective collating runs. The plurality of web rolls, already loaded in the combination storage and feeding carts, are placed in the multiple station collator. The innermost ribbon of each web roll is threaded around the dancer roller, the associated idler rollers, and over the corresponding pinroller where the aligning holes are engaged by the aligning pins. Next, the outer ribbon is threaded over the respective idler rollers and translating rollers and placed into superposed relationship with the inner ribbon by engaging the corresponding aligning holes on the same pinroller. The engagement of the aligning pins in the series of aligning holes assures that the superposed relationship will be maintained throughout the collation operation without requiring painstaking adjustments of idler rollers to precisely control the length of the respective paths of travel of each of the inner and outer ribbons. Consequently, set-up time is substantially reduced. In operation, the outer ribbon is in a slackened condition since the collation of the two ribbons is a direct result of the corresponding aligning holes being engaged by the pins maintaining the superposed relationship and not the exact lengths of the paths of travel of the ribbons.

The simplified set-up procedure makes the collating disclosed herein particularly well suited for short run jobs. The cost of set-up becomes a large part of the overall price of a short run printing job done on conventional equipment. The use of the collating equipment of this invention results in a substantial reduction of set-up cost with the greatest savings being evident for short run jobs.

The collating equipment is readily adaptable to collate magazines, booklets and similar printed material of varying numbers of pages. By engaging corresponding numbers of printed webs in the respective adjacent work stations of the collator it is possible to collate printed material varying from as little as eight pages to more than one hundred pages. The collator disclosed herein does not require modifications to the basic equipment when the number of pages to be collated is varied from job to job. The required number of web rolls are merely engaged in the corresponding number of work stations. Furthermore, the set-up time for material involving greater numbers of pages is minimized as the collation of the ribbons at each station is accomplished by the engagement of the pins in the pinrollers with the corresponding aligning holes of the ribbons. The collation of the respective pairs of ribbons at each station is similarly accomplished by placing the superposed pair of ribbons from the first station over the superposed pair of ribbons at the adjacent down line station and aligning pins at each adjacent down line pinroller with the holes in the corresponding multiple pairs of superposed ribbons. Specific adjustments need not be made to the equipment as the aligning pins maintain the superposed relationship of the pairs of ribbons.

The combination storage and feeding cart of this invention enables the printed material to be removed from the press and placed in a wheeled cart wherein the printed material can be moved to a location for storage and, when needed, brought to the collator and engaged therein without handling of the printed material. The cart allows the printed web to turn therein whereby the ribbons of printed material are unwound into the collating equipment.

Although the invention herein has been described with reference to particular embodiments, it it to be understood that these embodiments are merely illustrative of the principles in application of the invention. Thus, it is to be understood that numerous modifications may be made in the illustrative embodiments and other arrangements may be devised without departing from the spirit and scope of the invention.

What is claimed is:

1. An apparatus for collating printed material on a web roll with individual inner and outer web sections printed thereon which web sections are on a common core each of said sections having a series of aligning holes thereon along one edge of each of said web sections comprising a frame, at least one station of said frame adapted to receive said web roll, web drive means mounted on said frame and adapted to be engaged with said web roll when the latter is loaded into said station, a powered master roller mounted on said frame and positioned at said station, first means positioned at said station for directing said inner web section of said web over said master roller, second means positioned at said station for directing said outer web section of said web roll into collated and superposed relation to said inner web section on said master roller, and means associated with said master roller for maintaining said superposed relationship between said inner and outer web sections and for directing said superposed inner and outer web sections away from said station whereby the pre-printed inner and outer web sections emerge from said station in collated and superposed relation.

2. The apparatus as recited in claim 1 wherein said web drive means is comprised of a rotating member in engaging relationship with an outer surface of said web section adjacent said frame.

3. The apparatus recited in claim 1 wherein said first and said second web section directing means are each comprised of a plurality of cooperating rollers mounted on said frame.

4. The apparatus as recited in claim 1 wherein said means associated with said master roller is comprised of a plurality of radially extensible pins in said powered master roller adapted to be engageable in said series of aligning holes in each of said web sections.

5. A collator for assembling printed material from a plurality of web rolls each containing two individual side-by-side web sections wound on a common core with each web section having a series of aligning holes along one edge thereof comprising a support, a plurality of work stations along said support and each being adapted to receive one of said web rolls, drive means mounted on said support at each work station and adapted to engage with the corresponding web roll, a powered master roller mounted on said support at each work station, a plurality of first positioning rollers mounted at each work station adjacent said inner web section adapted to direct said inner web section over said master roller, a plurality of second positioning rollers mounted at each work station adjacent said outer web section adapted to direct said web section into superposed relation to said inner web section at said master roller, a plurality of extensible aligning pins on said master roller engaging said aligning holes in each of said web sections at each work station and adapted to direct said web sections along said support to an adjacent work station.

6. The apparatus as recited in claim 5 wherein each of said work stations is defined by a first and a second rail each extending substantially perpendicular to said support.

7. The apparatus as recited in claim 6 further including a movable cart at each station, each of said carts comprising a bottom portion engageable in said work station between said first and second rails, a first and a second upstanding wall mounted on said bottom portion, core receiving means in each of said upstanding walls adapted to rotatably mount said core in said cart at each station.

8. A collator for assembling printed material from a plurality of web rolls each containing two individual side-by-side web sections wound on a common core with each web section having a series of aligning holes along one edge thereof comprising a support, a plurality of work stations along said support and each being adapted to receive one of said web rolls, drive means mounted on said support at each work station and adapted to engage with the corresponding web roll, a powered master roller mounted on said support at each work station, a plurality of first positioning means mounted at each work station adjacent said inner web section adapted to direct said inner web section over said master roller, a plurality of second positioning means mounted at each work station adjacent said outer web section adapted to direct said outer web section into superposed relation to said inner web section at said master roller, a plurality of extensible aligning pins on said master roller engaging said aligning holes in each of said web sections at each work station and adapted to direct said web sections along said support to an adjacent work station.

9. An apparatus for collating printed material on a web roll with individual first and second web sections printed thereon which web sections are wound on a common core each of said sections having a series of aligning holes thereon along one edge of each of said web sections comprising a frame, at least one station of said frame adapted to receive said web roll, web drive means mounted on said frame and adapted to be engaged with said web roll when the latter is loaded into said station, a powered master roller mounted on said frame and positioned at said station, first means positioned at said station for directing said first web section of said web over said master roller, second means positioned at said station for directing said second web section of said web roll into collated and superposed relation to said first web section on said master roller, and means associated with said master roller for maintaining said superposed relationship between said first and second web sections and for directing said superposed first and second web sections away from said station whereby the pre-printed first and second web sections emerge from said station in collated and superposed relation.

10. The apparatus as recited in claim 9 wherein said web drive means is comprised of a rotating member in engaging relationship with an outer surface of at least one of said web sections.

11. The apparatus recited in claim 9 wherein said first and said second web section directing means are each comprised of a plurality of cooperating angle bars mounted on said frame.

12. The combination of a plurality of roll supporting carts each of which is constructed and arranged to rotatably support a web roll having individual first and second side-by-side web sections wound on a common core with each web section having aligning means therein adjacent one edge thereof, with a collator including an elongated support and a plurality of cart-receiving work stations disposed at spaced locations along said support and each work station including an inner support wall and being constructed for loading of one of said carts therein perpendicular to said inner support wall from the side adjacent said inner support wall and its corresponding web roll to orient the first and second web sections thereof into unwinding positions symetrically disposed in relation to a longitudinal medial plane of said work station, each of said stations including drive means mounted on said inner support wall and extending into an adjacent inner medial half-section of said work station and adapted to engage the corresponding first web section of said web roll to drive both sections thereof for collation, web section directing means arranged to receive said second web section and to translate the same from its position in an outer medial half-section of said work station into a collated and superposed position in relation to said first web section and in said inner medial half-section of said work station and web advancing means mounted on said inner support wall and disposed in said inner medial half-section and arranged to engage the superposed first and second web sections to advance the same into collated relation to corresponding first and second web sections in one or more of the longitudinally-spaced stations of the machine.

13. The combination set forth in claim 12 wherein said drive means is comprised of a rotating member in meshing relationship with said first web section of said web roll.

14. The combination set forth in claim 12 wherein said web section directing means is comprised of a plurality of rollers mounted on said inner support wall.

15. The combination set forth in claim 12 wherein said web advancing means is comprised of a rotating roller having a plurality of radially extensible pins therein adapted to cooperate with said aligning means in each of said web sections.

16. A collator for assembling printed material from a plurality of web rolls each containing at least two individual side-by-side web sections wound on a common core with each web section having a series of aligning holes along one edge thereof comprising a support, a plurality of work stations along said support and each being adapted to receive one of said web rolls, drive means mounted on said support at each work station and adapted to engage with the corresponding web roll, a powered master roller mounted on said support at each work station, a plurality of first positioning means mounted at each work station adjacent a first web section adapted to direct said first web section over said master roller, a plurality of second positioning means mounted at each work station adjacent a second web section adapted to direct said second web section into superposed relation to said first web section at said master roller, a plurality of extensible aligning pins on said master roller engaging said aligning holes in each of said web sections at each work station and adapted to direct said web sections along said support to an adjacent work station.

17. A collator for assembling printed material from a plurality of web rolls each containing two individual side-by-side web sections wound on a common core with each web section having a series of aligning holes along one edge thereof comprising a support, a plurality of work stations along said support and each being adapted to receive one of said web rolls, drive means mounted on said support at each work station and adapted to engage with the corresponding web roll, a plurality of powered master rollers each of said master rollers mounted on said support at each work station, a plurality of first positioning means mounted at each work station adjacent a first web section adapted to direct said first web section over one of said master rollers, a plurality of second positioning means mounted at each work station adjacent a second web section adapted to direct said second web section over another of said master rollers at an adjacent work station, means for superposing said second web section with said first web section, and a plurality of extensible aligning pins on each of said master rollers engaging said aligning holes in each of said web sections at each work station and adapted to direct said web sections along said support to an adjacent work station.

* * * * *